US008206003B1

(12) United States Patent
LaBarge

(10) Patent No.: US 8,206,003 B1
(45) Date of Patent: Jun. 26, 2012

(54) ILLUMINATED TOILET PAPER HOLDER

(76) Inventor: Richard W. LaBarge, Colchester, VT (US)

( * ) Notice: Subject to any disclaimer, the term of this patent is extended or adjusted under 35 U.S.C. 154(b) by 0 days.

(21) Appl. No.: 13/011,855

(22) Filed: Jan. 21, 2011

(51) Int. Cl.
*F21V 33/00* (2006.01)
*F21V 23/00* (2006.01)
*F21L 4/08* (2006.01)
*B65D 85/67* (2006.01)

(52) U.S. Cl. ..... 362/154; 362/183; 362/186; 362/276; 206/389

(58) Field of Classification Search ..... 362/154, 362/183, 186, 253, 276, 802; 206/233, 389, 206/398, 407; 211/16; 221/45, 46, 282; 242/570; 312/34.8
See application file for complete search history.

(56) References Cited

U.S. PATENT DOCUMENTS

| | | | | | |
|---|---|---|---|---|---|
| 1,505,688 | A | * | 8/1924 | Arelt | 221/57 |
| 4,213,536 | A | * | 7/1980 | Hafner | 220/663 |
| 4,700,048 | A | * | 10/1987 | Levy | 219/214 |
| 4,882,568 | A | | 11/1989 | Kyser | |
| 5,036,443 | A | * | 7/1991 | Humble et al. | 362/183 |
| 5,178,450 | A | * | 1/1993 | Zelensky et al. | 362/154 |
| 5,367,442 | A | * | 11/1994 | Frost et al. | 362/183 |
| 5,453,729 | A | * | 9/1995 | Chu | 340/332 |
| 5,624,025 | A | | 4/1997 | Hixon | |
| 5,697,577 | A | * | 12/1997 | Ogden | 242/598.6 |
| D419,012 | S | | 1/2000 | Wiggins | |
| 6,056,233 | A | * | 5/2000 | Von Schenk | 242/594.5 |
| 6,068,118 | A | * | 5/2000 | Calloway | 206/233 |
| D455,924 | S | | 4/2002 | Zetsche | |
| 6,402,338 | B1 | * | 6/2002 | Mitzel et al. | 362/154 |
| D478,753 | S | | 8/2003 | Hall | |
| 6,932,496 | B2 | * | 8/2005 | Rizkin et al. | 362/299 |
| 7,513,638 | B2 | * | 4/2009 | Allsop et al. | 362/183 |
| 7,699,490 | B2 | * | 4/2010 | Tsai et al. | 362/154 |
| 7,832,890 | B2 | * | 11/2010 | Jesse | 362/154 |
| 2004/0160775 | A1 | | 8/2004 | Goodlett | |
| 2005/0126942 | A1 | * | 6/2005 | McAndrew | 206/349 |
| 2005/0146874 | A1 | * | 7/2005 | Cech et al. | 362/253 |
| 2007/0267533 | A1 | | 11/2007 | Reid | |
| 2008/0266844 | A1 | | 10/2008 | Reynolds | |

* cited by examiner

*Primary Examiner* — Alan Cariaso
(74) *Attorney, Agent, or Firm* — Dorothy S. Morse

(57) ABSTRACT

An illuminated holder for storing one roll of toilet paper in a protected and conveniently accessible position atop a toilet tank, although positioning in other conveniently accessible locations in a bathroom is also contemplated. The holder has a grooved base, a cylindrical main body, an upwardly-tapering cap, and a light emitting diode (LED) that provides a source of illumination through a translucent light shield positioned between the main body and the cap. A photovoltaic cell and rechargeable battery preferably power the LED light, and a sensor automatically activates the LED light in dimly lit surroundings. One roll of toilet paper is placed on the base at a time, and then covered until needed by the assembled main body, shield, and cap. Optionally, the base may have high-friction feet configured for gripping the top of a toilet tank cover and maintaining the holder in its desired position of use.

20 Claims, 15 Drawing Sheets

13

ILLUMINATED TOILET PAPER HOLDER

CROSS-REFERENCES TO RELATED APPLICATIONS

None.

BACKGROUND

1. Field of the Invention

This invention relates to toilet paper holders, specifically to an illuminated holder configured for storing and protecting one roll of toilet paper in a conveniently accessible position atop a toilet tank. The present invention holder has a base and a multi-part top unit (comprising a cap, light shield, and main body) that is lifted upwardly and away from the base for access to the stored roll. A light emitting diode (LED) provides illumination through the translucent light shield, so that the holder can also provide a nightlight function in dimly lit surroundings. In addition, the upper-central positioning of the light shield, in combination with the cylindrical configuration of the main body, gives a generally lighthouse-shaped appearance to the present invention. A sensor/switch automatically activates the LED light when ambient light falls below a pre-determined intensity, and a dual power arrangement is provided for the LED light through use of a photovoltaic cell and a rechargeable battery. For added stability, the base has a perimeter groove into which the bottom edge of the cylindrical main body is placed, and the base may have high-friction feet configured to maintain the holder in its intended position of use. Materials selected for the present invention toilet paper holder are chosen to be easily cleaned, water-resistant, corrosion-resistant, impact-resistant, durable, and attractive so as to enhance the overall design. Also, although serving a functional use, it is further intended for the present invention to have a decorative and aesthetically pleasing construction, with a simple and modern appearance suitable for use with a wide variety of bathroom décor.

2. Description of the Related Art

Toilet paper for residential use is generally sold in rolls having a limited maximum size, and a roll of toilet paper mounted in the primary dispenser of a bathroom can be used up quickly in households having a large number of people. Thus, it is helpful to have at least one spare roll of toilet paper nearby, for the frequent and repeated occurrences when little toilet paper remains in the primary dispenser. When a spare roll of toilet paper is simply placed on the top of a toilet tank cover without any means of protection, while waiting for use, the sanitary nature and/or integrity of the toilet paper can become compromised by potential contact with dust, toiletry products, a wet bathroom floor, children, pets, and insects that can drawn to moisture present in a bathroom. The present invention provides a safe and sanitary environment for a spare roll of toilet paper, while also providing a modern and aesthetically pleasing exterior configuration that complements a wide variety of bathroom décor, in addition to providing a nightlight function that, among other things, makes it easier to find and/or change out a toilet paper roll in low light conditions. Since many residential bathrooms are small, it would be desirable to have a holder for a single roll of toilet paper that is configured for use atop a toilet tank cover, particularly a holder with an incorporated source of illumination and a simple design that attractively complements bathroom décor.

Many prior art toilet paper holders are known, including those configured as flexible covers for storing multiple toilet paper rolls at once, those that have rigid housings configured to store two or more rolls of toilet paper, and "add-on" holders (both covered and non-covered) that maintain a single roll of toilet paper in close association with a primary dispenser. One disadvantage of add-on toilet paper holders, particularly non-covered ones, is that they typically place a toilet paper roll in a position lower than the primary dispenser, wherein toilet paper in the add-on holder is more easily accessible to curious children and pets who may repeatedly unroll it, or otherwise play with it. Also, storage containers for holding multiple spare rolls of toilet paper are generally too large for safe or attractive placement on the top cover of a toilet tank.

One prior art toilet paper holder that could be stored atop a toilet tank is the invention disclosed in U.S. Design patent D455,924 to Zetsche (2002), which comprises a base/spindle configuration made from three stacked cylinders of increasingly smaller diameter, with the bottommost cylinder serving as a support base for a roll of toilet paper. The Zetsche invention also has a truncated cone positioned on its side and having its narrow end attached to the bottommost cylinder, in the manner of a handle. However, a roll of toilet paper supported by the Zetsche invention remains uncovered, while in contrast, the main body of the present invention has a differing structure, without an upwardly-extending central spindle, that completely covers a roll of toilet paper to maintain it in a more sanitary condition than can be achieved by the Zetsche invention. Another prior art toilet paper holder that could be stored atop a toilet tank is the invention disclosed in U.S. pre-grant published patent application 2007/0267533 to Reid, which is configured in the shape of a miniature toilet bowl and tank, with a roll of toilet paper being stored in the toilet bowl, under a lid. While the Reid invention is whimsical and does cover a toilet paper roll to protect it prior to use, the simple and modern, and even futuristic, appearance of the present invention holder is different in structure and would more likely be suitable with a wider variety of bathroom décor. Also, neither the Reid or Zetsche inventions have provisions for illumination, as is provided by the present invention.

In addition, there are toilet paper dispensers and spare roll holders known with battery power and/or illumination, such as the invention disclosed in U.S. Pat. No. 4,882,568 to Kyser (1989) that identifies a toilet paper dispenser with an LED light that becomes lit when the toilet paper on the roll is nearly spent; the invention disclosed in U.S. pre-grant published patent application 2004/0160775 to Goodlett for a standoff dispensing fixture (usable in pairs) having a base configured for mounting to a wall, a pair of LED lights attached to the base, a rod standoff secured to the base for generally perpendicular positioning relative to the supporting wall, a light-transmitting and open-ended side wall, an end cap with a transverse opening therethrough for accommodation of a towel or tissue rod, and a threaded fastener positioned through the end of the cap for connection with the distal end of the rod standoff so as to secure the side wall between the cap and the base; and U.S. Pat. No. 5,624,025 to Hixon (1997) that identifies a wall-mounted, rectangular-shaped, and multi-purpose toilet paper dispenser configured to also hold a nightlight assembly, a pencil holder, and air freshener. All of these inventions are structurally different from the present invention spare toilet paper roll holder, they are mountable to a wall (instead of positioning atop a toilet tank cover), they are dispensers instead of a spare roll holder, and they do not identify a rechargeable source of power for its light or lights. Furthermore, U.S. Pre-grant published patent application 2008/0266884 to Reynolds discloses a task light that can be used in association with a roll dispenser in the absence of sufficient natural lighting. It is removably mounted to a wall above a toilet paper dispenser, and it has a semi-translucent case that becomes illuminated when an internal LED light is activated. The Reynolds device also is activated by the proximity of a user's hand near the associated toilet paper dispenser, and has a timer circuit for automatic shut-off until it is again activated by the nearby motion of a user's hand. However, the Reynolds device is not configured to store a roll of toilet paper and does not reveal on-board recharging of its battery power.

In addition, two U.S. patents each disclose a holder for a spare roll of toilet paper having the generally cylindrical appearance found in the main body of the present invention, U.S. Design patent D478,753 to Hall (2003) which discloses a camper's/traveler's toilet paper holder with a snap-on lid, and U.S. Design patent D419,012 to Wiggins that discloses a tall, illuminated, and generally cylindrical-shaped holder for multiple rolls of toilet paper. However, the top snap-on lid of the Hall invention requires two hands for opening and is less convenient for accessing a spare roll of toilet paper than the lift-off configuration of the present invention's multi-part top unit, and the large height dimension of the Wiggins invention makes it inconvenient for storage atop a toilet tank. Also, although the title of the Wiggins invention indicates a source of illumination, the source and positioning of that illumination is not clear in the accompanying illustrations. However, no photo-sensor/switch is visible on any of its exterior surfaces. Also, neither the Hall or the Wiggins invention appears to have the upper-central light shield positioning of the present invention, nor photovoltaic cell recharging of any on-board battery. No other toilet paper holder is known having the same structure as the present invention, that functions in the same manner as the present invention, or provides all of the features and advantages of the present invention.

BRIEF SUMMARY OF THE INVENTION

It is the primary object of this invention to provide a holder for a single roll of toilet paper that is capable of being placed atop a toilet tank cover and has a light source that generally functions as a nightlight during low light conditions. A further object of this invention is to provide a holder for a single roll of toilet paper that is made from materials that are easily cleaned, water-resistant, corrosion-resistant, impact-resistant, and durable. It is a further object of this invention to provide a holder for a single roll of toilet paper that has an attractive design and construction. It is also an object of this invention to provide a holder for a single roll of toilet paper that can be easily and quickly opened for removal and replacement of a roll of toilet paper. A further object of this invention is to provide a holder for a single roll of toilet paper with automated light source activation. Another object of this invention to provide a holder for a single roll of toilet paper with a readily-accessible battery storage compartment configured for prompt and easy battery exchange. It is also an object of this invention to provide a holder for a single roll of toilet paper that can be located out of the reach of curious children and pets.

The present invention, when properly made and used, provides an illuminated holder configured for storing one roll of toilet paper in a protected and conveniently accessible position atop a toilet tank cover, although location in other conveniently accessible positions in a bathroom is also contemplated, such as but not limited to a nearby countertop, decorative stand, or table. The present invention holder has a base with a top perimeter groove, a cylindrical main body having a closed top end and a diameter dimension sufficiently large to hold a roll of toilet paper sized for residential use, an inwardly and upwardly tapering cap, and a light emitting diode (LED) light source that provides illumination through a light shield positioned between the main body and the cap, so that the holder can also provide a nightlight function in dimly lit surroundings. Although a photo-sensor/switch (preferably comprising a photovoltaic cell) is secured to the cap (or a top plate supporting the cap), a dual power option is provided in the present invention wherein either a rechargeable or disposable/non-rechargeable battery may be used. If a disposable/non-rechargeable battery is placed in the battery compartment of the present invention, the photo-sensor/switch will automatically cause activation of the LED light source at night, and during other times when low ambient light occurs. When available power in the disposable/non-rechargeable battery becomes depleted, it is simply exchanged for a replacement battery. However, as a result of the small amount of power consumed by an LED light during its operation, and operation of the present invention LED light source occurs only during low ambient light conditions, infrequent battery replacement is anticipated. In the alternative, when a rechargeable battery is used to power the present invention, the on-board photovoltaic cell recharges the battery during brightly lit conditions, and repeat operation of the LED light source during periods of low ambient light is expected to occur without frequent battery exchange, even when weather, seasonal influences, and/or other conditions temporarily interrupt the brightly lit conditions needed for battery recharging. Additionally, since a photo-sensor/switch automatically activates the LED light in dimly lit surroundings, no manually-operated on-off switch is used. One roll of toilet paper can be placed upon the base at a time. The roll is then covered until needed by lowering the assembled main body, shield, and cap (as a multi-part top unit) downwardly over the roll. For added stability and centering of the multi-part top unit, the base has a perimeter groove into which the bottom of the cylindrical main body is placed. Access to the toilet paper roll is provided by prompt and easy lifting of the multi-part top unit upwardly from the base. Optionally, the base may have high-friction feet configured to maintain the holder in its needed position atop a toilet tank cover. Furthermore, materials selected for the present invention toilet paper holder are chosen to be easily cleaned, water-resistant, corrosion-resistant, impact-resistant, durable, and attractive so as to enhance the overall design. Although serving a functional use, it is also intended for the present invention to have a decorative and aesthetically pleasing construction, with a simple and modern appearance suitable for use with a wide variety of bathroom décor.

The description herein provides preferred embodiments of the present invention but should not be construed as limiting its scope. For example, variations in the size and exterior appearance of the light shield; the number of feet used as a part of its base; the type and number of LED lights used; the amount and type of exterior surface decoration associated with its cap, cylindrical housing, and base; the size and configuration of reflector used; and the relative width dimensions of the cap, light shield, and main body, other than those shown and described herein, may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 1:
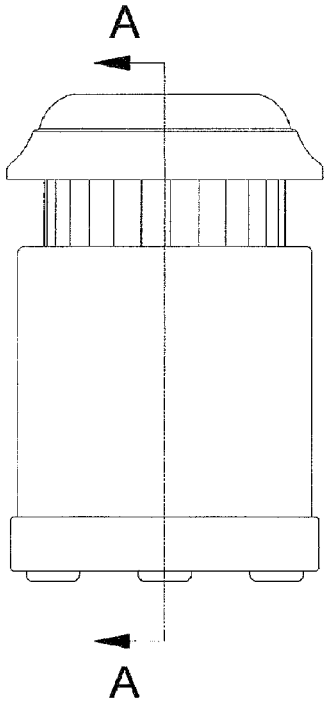
FIG. 1 is a first side view of the most preferred embodiment of the present invention with a marked section line A-A.

The present invention is a holder for a single roll of toilet paper that is sufficiently compact in size to allow placement on top of a toilet tank cover in a position of convenient access. Placement atop a toilet tank cover also advantageously locates the stored spare roll of toilet paper out of the reach of curious children and pets. The photo-sensor/switch 14*a* on the exposed surface its top plate 14 also allows for automated light source 8 activation in low light conditions, so that the present invention can be used as a nightlight during evening hours and when low light conditions unexpectedly occur, such as when municipal power supplies suddenly fail. Photo-sensor/switch 14*a* can also be employed to recharge a battery (not shown) positioned for use within its battery holder 6, and as an alternative power supply option, holder 6 may contain a disposable battery (not shown). Furthermore, the lightweight materials typically used for the present invention cylindrical main body 2, base 1, cap 13, and light shield 3 are easily cleaned, water-resistant, corrosion-resistant, impact-resistant, and durable, and may include, but are not limited to stainless steel, aluminum, copper, brass, silver, silver-plate, gold, gold-plate, other metals, other plated materials, porcelain, ceramic, translucent plastic, and opaque plastic. Base 1 may also have feet 1*c* made from high-friction material configured for maintaining it in a needed position of use atop a toilet tank cover. The present invention has the general appearance of a lighthouse, and its design is modern and aesthetically pleasing, even futuristic, which attractively complements a wide variety of bathroom décor. In addition, the present invention holder is easily opened for insertion and release of a spare roll of toilet paper simply by lifting its cylindrical main body 2 from its base 1. The cap 13 of the present invention typically secured to main body 2 during present invention use, is separable from cylindrical main body 2 via a bayonet or other twisting-type of action, for easy battery (not shown) replacement. Due to the long life of the LED light source 8 contemplated for use in the most preferred embodiment of the present invention, provisions for easy light source 8 replacement have not been incorporated into present invention structure.

Figure 5:
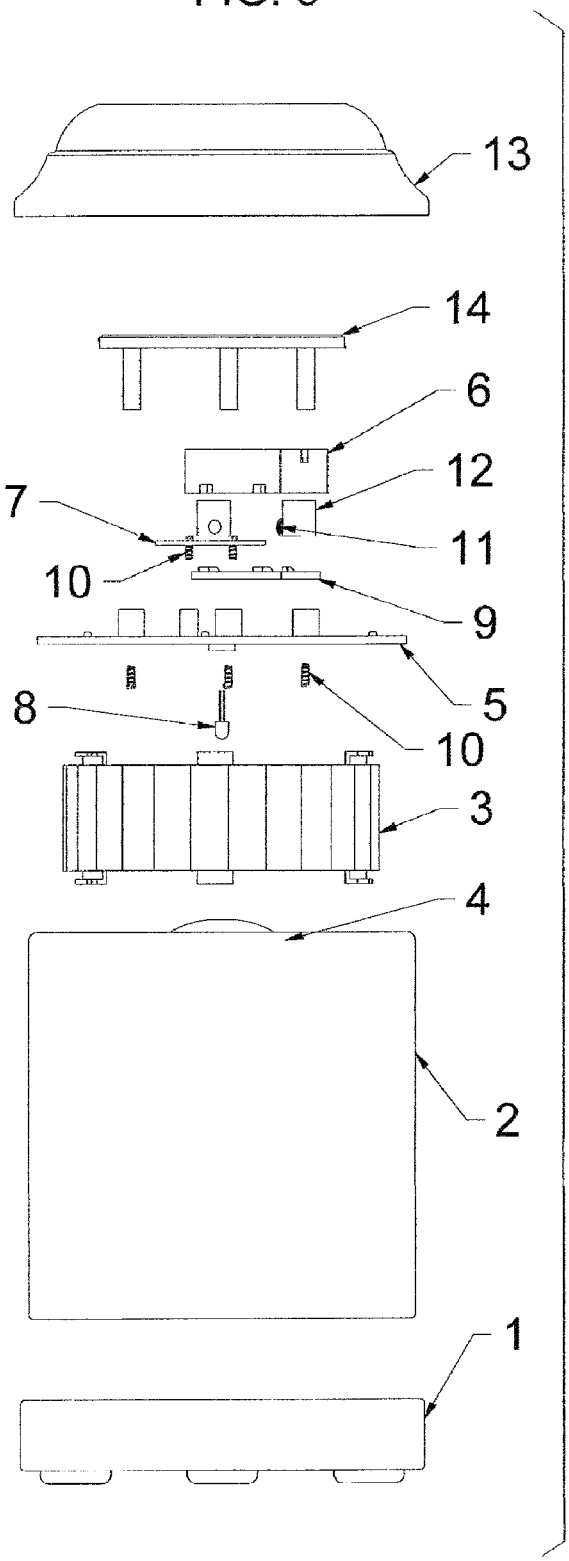
FIG. 5 is an exploded view of the invention.
Figure 6:
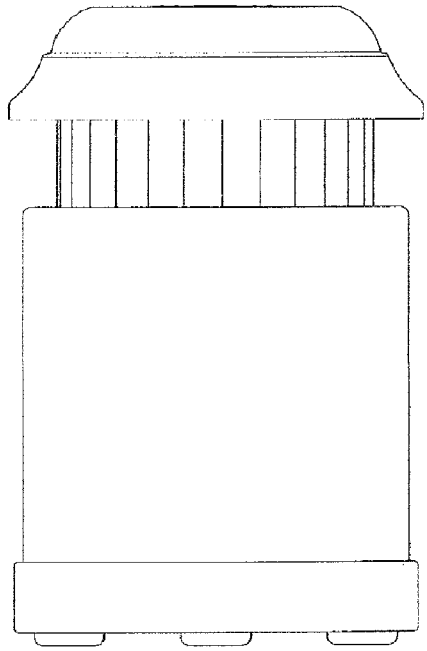
FIG. 6 is a second side view of the invention taken at 90-degrees to that shown in FIG. 1.
Figure 7:
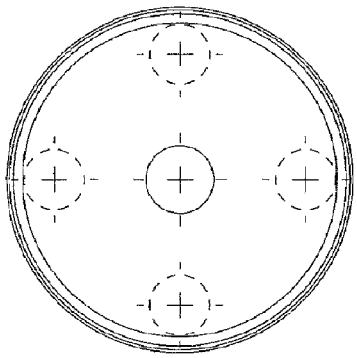
FIG. 7 is a top view of the base used as a part of the most preferred embodiment of the present invention.
Figure 63:
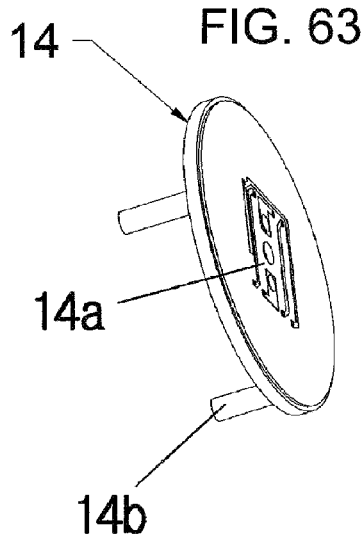
FIG. 63 is a perspective view of the top plate of the invention showing its top and side surfaces, and the photo-sensor/switch associated with the top surface.

While FIGS. 1-6 show the present invention illuminated holder for a single roll of toilet paper in its entirety, and FIGS. 7-63 conversely show enlarged illustrations of individual present invention components that clearly identify preferred structural details thereof, and further since all illustrations in FIGS. 7-63 relating to a one component are situated on a single drawing sheet for easy reference, for simplicity and clarity of illustration, the numerals used to identify component sub-parts in FIGS. 7-63 are not provided in each drawing, and instead are only marked once per drawing sheet. Furthermore, although not limited thereto, the preferred diameter dimension for base 1 and main body 2 is between five and six inches, with the height dimension of light shield 3 being a little over one inch, and the overall height of the assembled present invention being approximately nine inches. However, it must be re-emphasized that non-patentably-distinct variations other than those shown and described herein, may be incorporated into the present invention, and as a result thereof, the scope of the present invention should be determined by the appended claims and their legal equivalents, rather than being limited to the examples given provided hereinbelow and elsewhere in this disclosure.

Figure 2:
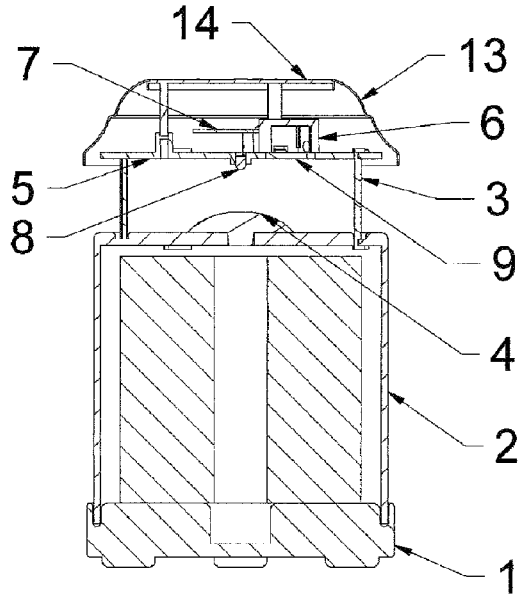
FIG. 2 is a sectional view of the invention taken along section A-A in FIG. 1.
Figure 3:
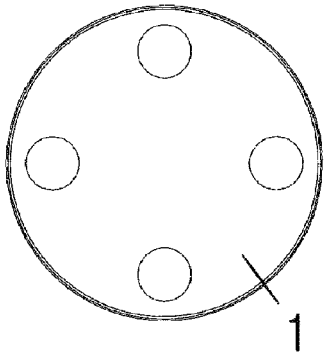
FIG. 3 is a bottom view of the invention.
Figure 4:
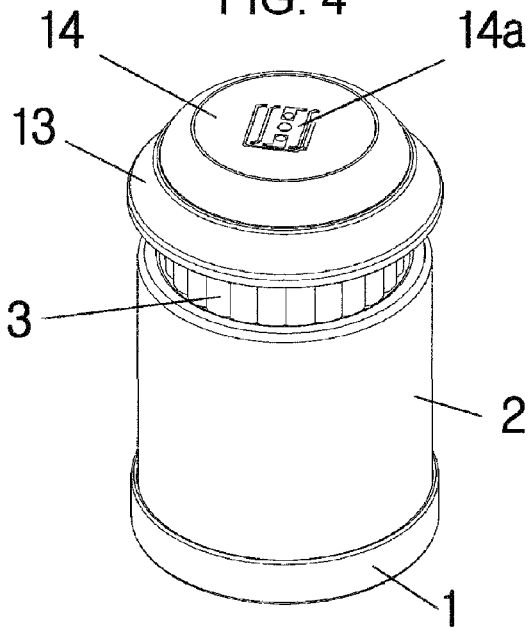
FIG. 4 is a perspective view of the invention.

FIGS. 1-6 show the present invention illuminated holder for a single roll of toilet paper as a whole, in assembled and unassembled form. FIG. 1 is a first side view of the most preferred embodiment of the present invention with a marked section line A-A, while FIG. 2 is a sectional view of the invention taken along section A-A in FIG. 1, with FIG. 6 being a second side view of the invention taken at 90-degrees to that shown in FIG. 1. As can be seen in FIGS. 1 and 6, the present invention appears substantially similar from all sides. Also, the sectional view in FIG. 2 shows the bottom edge of main body 2 inserted into a perimeter groove (marked by the numeral 1*a* in FIG. 10) within base 1. FIG. 2 further shows the stem (marked with the numeral 4*a* in FIG. 22) of a generally mushroom-shaped reflector 4 being supported by the top closed end (marked with the numeral 2*a* in FIG. 16) of main body 2, the lower end of a light shield 3 secured to top end 2*a*, and a horizontally-extending light-holding bracket 5 secured to the upper end of light shield 3. A light source 8 is supported in a downwardly-extending orientation by bracket 5, in a position directly above reflector 4. Light source 8 should have low power consumption, bright emitted light, and low heat production, and in the most preferred embodiment of the present invention, light source 8 comprises a light emitting diode (LED). FIG. 2 further shows several components positioned between light-holding bracket 5 and top photo-sensor/switch plate 14, including a circuit board 7 that is not typically accessed during present invention use. FIG. 2 also identifies the presence and location of a battery compartment 6 and a snap-in battery compartment cover 9 configured to seal a rechargeable or non-rechargeable battery within battery compartment 6, with only the battery compartment cover 9 being removable through the large opening 5*b* in bracket 5 for battery replacement. In addition, FIG. 3 is a bottom view of the invention that reveals base 1 having four spaced-apart feet (marked with the numeral 1*c* in FIG. 11). While the number of feet 1*c* used may be different from that shown, the number employed should be determined by the benefit and/or decorative enhancement provided. Also, while not limited thereto, feet 1*c* may comprise high-friction material or design that resists movement of the present invention from its intended location of use. In addition, feet 1*c* may be integral to base 1 via molded construction, or added to base 1 during manufacture or thereafter by an end user. FIGS. 4 and 5 respectively are a perspective view and an exploded view of the invention. FIG. 4 shows photo-sensor/switch 14*a* being exposed through the top center portion of cap 13, and both cap 13 and photo-sensor/switch plate 14 positioned above light shield 3. The relative height dimensions shown for base 1, cylindrical main body 2, light shield 3, and cap 13 in FIGS. 4 and 5 are not critical, and not limited to that shown. However, a compact and lightweight construction for the present invention is preferred, and would be taken into consideration when determining the height dimensions of present invention components. FIG. 5 discloses all of the same internal components in the sectional view of FIG. 2, except that FIG. 5 also shows a battery spring 11, two battery contacts 12, and several fasteners 10 used to secure the mounting projections 14*b* associated with top photo-sensor/switch plate 14 to large threaded mounts 5*c* on light-holding bracket 5, and also secure circuit board 7 to small mounts 5*d* on bracket 5. Since FIGS. 1-6 are intended to show the most preferred embodiment of the present invention, it is contemplated for non-patentably distinct variations from that shown to occur in all identified components.

Figure 8:
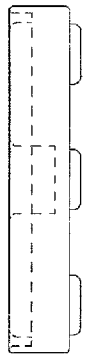
FIG. 8 is a first side view of the base of the invention.
Figure 9:
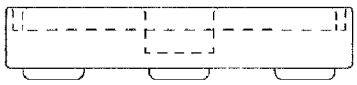
FIG. 9 is a second side view of the base of the invention taken at 90-degrees to that shown in FIG. 8.
Figure 10:
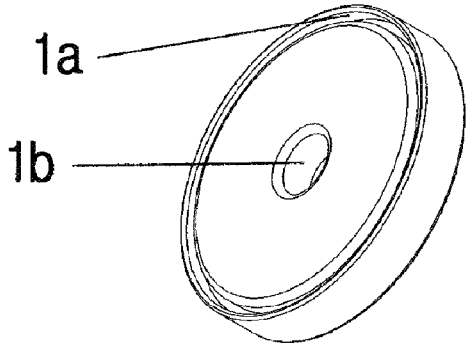
FIG. 10 is a perspective view of the top surface of the base of the invention, showing a central bore therein.
Figure 11:
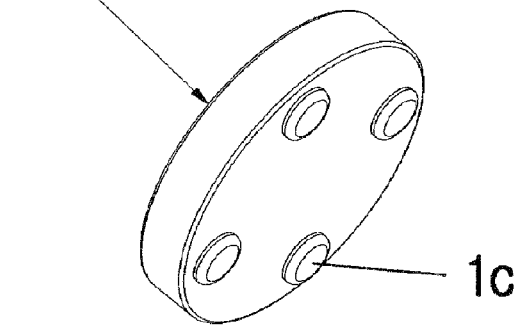
FIG. 11 is a perspective view of the bottom surface of the base of the invention, showing four equally sized and spaced-apart projections/feet depending therefrom.

FIGS. 7-11 show enlarged views of the base 1 used as a part of the most preferred embodiment of the present invention. FIG. 7 is a top view of base 1, with FIG. 8 showing a first side view of base 1 and FIG. 9 providing a second side view of base 1 taken at 90-degrees to that shown in FIG. 8. FIG. 7 shows base 1 having a central bore 1*b* on the interior surface of base 1 that receives a roll of toilet paper (not shown) for temporary storage thereof. Central bore 1*b* is a target for roll placement, wherein speed and accuracy of toilet paper roll replacement is enhanced when the center of a roll of toilet paper is aligned with central bore 1*b* before being covered by main body 2. Central bore 1*b* also helps to reduce material and shipping costs for the present invention. FIGS. 8, 9, and 11 show that central bore 1*b* does not extend entirely through base 1. FIG. 7 also shows base 1 having a perimeter groove (more clearly illustrated in FIG. 10, and marked by the numeral 1*a* therein). Furthermore, via broken lines FIG. 7 shows base 1 having four spaced-apart feet (marked by the numeral 1*c* in FIG. 11). Feet 1*c* may be a molded part of base 1, or attached to base 1 during manufacture or by an end user. Feet 1*c* may have a high-friction enhanced-gripping capability adapted fore more secure positioning atop a toilet tank cover. Furthermore, the enhanced grip of feet 1*c* (when provided) may result from the materials used, surface texture, or a combination thereof. The 'site' markings in FIG. 7 related to feet 1*c* and central bore 1*b* indicate depth dimension extending away from a viewer. FIG. 10 is a perspective view of the top surface of base 1 used for receipt of a roll of toilet paper, while FIG. 11 shows a perspective view of the bottom surface of base 1 that would face/engage the top surface of a toilet tank cover (not shown). Although the preferred embodiment of base 1 is shown in FIGS. 7-11, base 1 may have non-patentably distinct variations from that shown, including but not limited to a differing thickness dimension, a different diameter dimension (although not smaller than the diameter of main body 2), feet 1*c* having a differing size and/or configuration, a different number of feet 1*c*, a different depth dimension for groove 1*a*, a different depth dimension for central bore 1*b*, and differences in surface texture and/or decoration.

Figure 12:
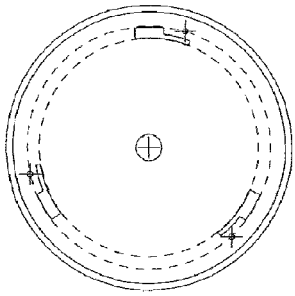
FIG. 12 is a top view of the cylindrical main body used as a part of the most preferred embodiment of the present invention, showing its top closed end, with broken lines indicating a recess/groove.
Figure 13:
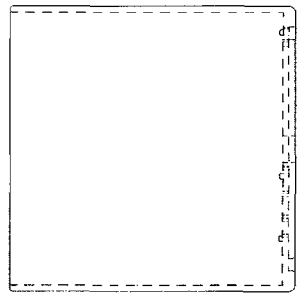
FIG. 13 is a first side view of the cylindrical main body of the invention.
Figure 14:
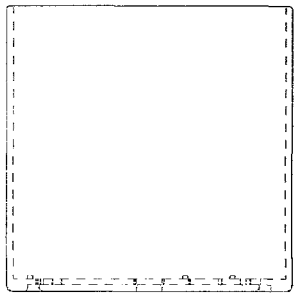
FIG. 14 is a second side view of the cylindrical main body of the invention taken at 90-degrees to that shown in FIG. 13.
Figure 15:
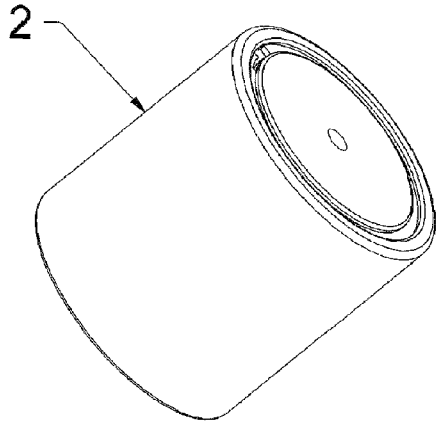
FIG. 15 is a perspective view of the cylindrical main body of the invention showing its closed top end.
Figure 16:
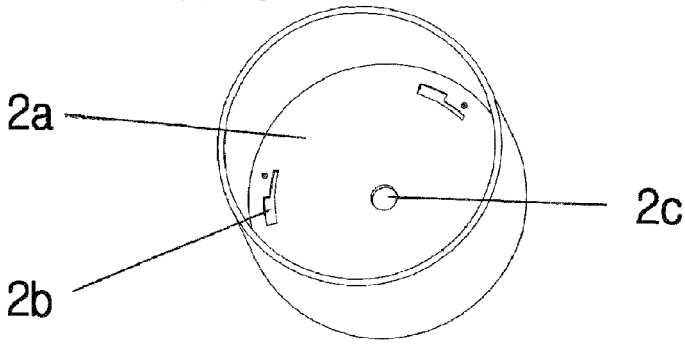
FIG. 16 is a perspective view of the cylindrical main body of the invention showing its interior cavity, closed top end, central bore, keyhole-shaped slots, and locking nodes that provide a secure connection between the main body and the light shield.

FIGS. 12-16 show enlarged views of the cylindrical main body 2 used as a part of the most preferred embodiment of the present invention. As can be seen in all FIGS. 12-16, main body 2 has a closed top end 2*a* with a center bore 2*c* and recessed keyhole-shaped slots 2*b*. FIG. 12 is a top view of main body 2 and shows center bore 2*c*, and slots 2*b* in a perimeter recess marked by broken lines. FIG. 13 is a first side view of main body 2, and FIG. 14 provides a second side view of main body 2 taken at 90-degrees to that shown in FIG. 13. In addition, FIG. 15 is a perspective view of main body 2 showing its top surface 2*a* and a portion of its exterior surface. During use of main body 2, top surface 2*a* would be covered by light shield 3 and cap 13, and also releasably connected to the L-shaped projections 3*a* depending from one end of light shield 3 (shown in FIG. 20). FIG. 16 is a perspective view of main body 2 showing the interior cavity that is sized and configured to hold a roll of toilet paper. Also, as shown in the assembled holder illustrated in FIG. 2, it is contemplated for the stem 4*a* on reflector 4 to engage center bore 2*c* and result in reflector 4 positioning that is close to light source 8. Main body 2 can be made from a variety of materials. However, in the most preferred embodiment of the present invention it is contemplated for such materials to be lightweight for easy lifting and prompt access to a spare roll of toilet paper. Furthermore, although FIG. 15 shows the exterior surface of main body 2 in an unadorned state, and such appearance is preferred, it is considered to be within the scope of the present invention for main body 2 to include different exterior surface textures and/or design.

Figure 17:
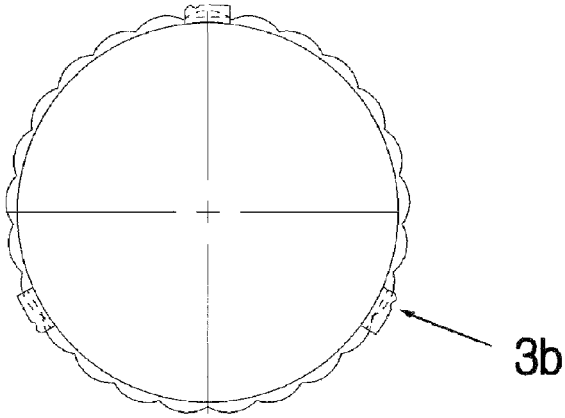
FIG. 17 is a top view of the light shield used as a part of the most preferred embodiment of the present invention.
Figure 18:
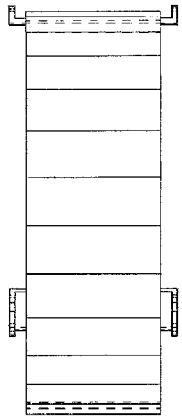
FIG. 18 is a first side view of the light shield of the invention.
Figure 19:
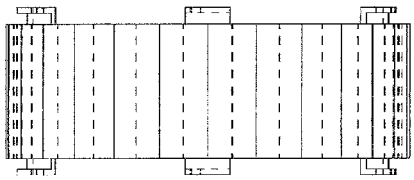
FIG. 19 is a second side view of the light shield of the invention taken at 90-degrees to that shown in FIG. 18.
Figure 20:
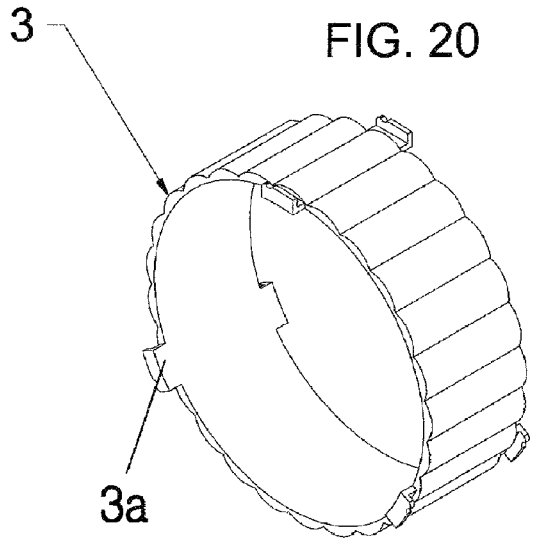
FIG. 20 is a perspective view of the light shield of the invention showing its generally tubular construction, and the opposed L-shaped projections that either engage keyhole-shaped slots in the cylindrical main body and the light-holding bracket.

FIGS. 17-20 show enlarged views of the translucent light shield 3 used as a part of the most preferred embodiment of the present invention. As can be seen in mainly in FIGS. 17 and 20, light shield 3 has an open-ended tubular configuration, and as can also be easily seen in FIGS. 19 and 20, light shield 3 has three spaced-apart and generally L-shaped projections 3*a* on each of its ends that are used with the key-hole shaped slots 5*a* and 2*b* (respectively identified in FIGS. 25 and 16 as a part of the construction for light-holding bracket 5 and the top surface 2*a* of main body 2). The number, size, configuration, location, and spaced-apart distance of projections 3*a* from one another are not critical, and not limited to that shown in FIGS. 17-20, as long as they securely connect light shield 3 to main body 2 and bracket 5. Also, the external design/texture of light shield 3 is not limited to that shown in FIGS. 17-20, although such scalloped design/texture is preferred. FIG. 17 is a top view of light shield 3, while FIG. 18 is a first side view of light shield 3, and FIG. 19 provides a second side view of light shield 3 taken at 90-degrees to that shown in FIG. 18. In addition, FIG. 20 is a perspective view of most preferred embodiment of light shield 3 showing its generally tubular construction and the three spaced-apart L-shaped projections 3*a* depending beyond each of its opposed ends. It is contemplated in the most preferred embodiment of the present invention for light shield 3 to be made from translucent materials to allow transmission therethrough of emitted light from light source 8. However, it is not generally contemplated for light shield 3 to be made from glass, as glass is typically heavier than plastic and would add unneeded weight to the multi-part top unit that a user must repeated lift to access toilet paper rolls. The increased weight would also adversely impact shipping cost. In addition, a light shield made from glass would present a potential hazard should it break on a bathroom floor. A small notch marked by the numeral 3*b* in FIG. 17 is also shown in the distal end of each L-shaped projection 3*a*, which is contemplated for mating with one of the locking nodes 5*f* in FIG. 28 (and with similar unmarked nodes near the slots 2*b* in FIGS. 12 and 16). The combination of locking nodes 5*f* (and unmarked nodes in FIGS. 12 and 16) with the notches 3*b* in FIG. 17 provides a secure connection between light shield 3 and bracket 5, that remains undisturbed by casual contact. However, when battery replacement is required, or replacement of the cap 13 and the present invention components positioned between cap 13 and bracket 5, then a bayonet turn (or other twisting force) can overcome the connection and release locking nodes (5*f* and other) from notches 3*b*.

Figure 21:
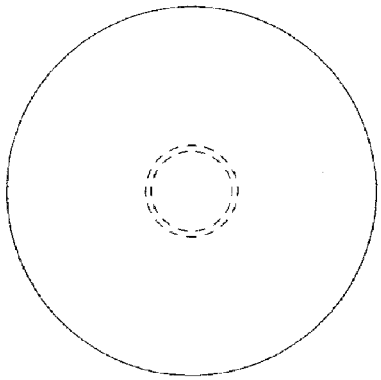
FIG. 21 is a top view of the generally mushroom-shaped reflector used as a part of the most preferred embodiment of the present invention, with broken lines indicating the stem hidden on the reflector's reverse surface.
Figure 22:
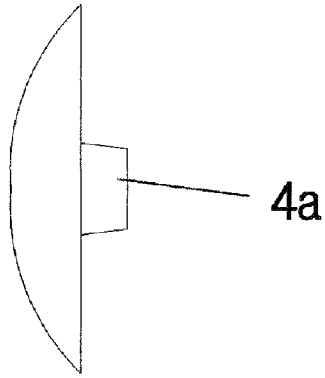
FIG. 22 is a first side view of the reflector of the invention.
Figure 23:
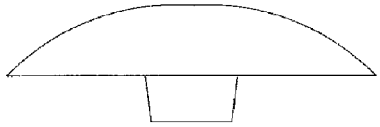
FIG. 23 is a second side view of the reflector of the invention taken at 90-degrees to that shown in FIG. 22.
Figure 24:
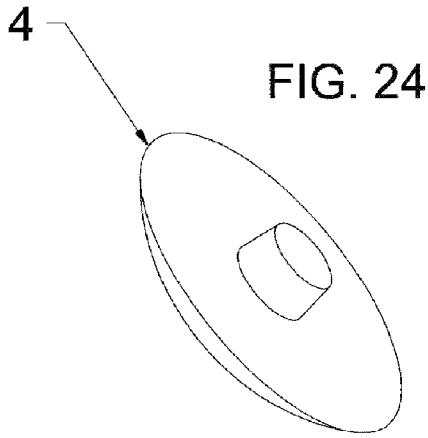
FIG. 24 is a perspective view of the reflector of the invention showing its bottom surface and centrally-positioned stem.

FIGS. 21-24 show enlarged views of the reflector 4 used as a part of the most preferred embodiment of the present invention. FIG. 21 is a top view of reflector 4 showing its hidden stem (marked by the numeral 4*a* in FIG. 22) in broken lines, while FIG. 22 is a first side view of reflector 4, and FIG. 23 provides a second side view of reflector 4 taken at 90-degrees to that shown in FIG. 22. In addition, FIG. 24 is a perspective view of reflector 4 showing stem 4*a* on its bottom surface. The configuration shown in FIGS. 21-24 is not critical, and the top surface of reflector 4 may have alternative sizes and shapes, according to need, as may its stem 4*a*. However, it is contemplated for reflector 4 to have a reflective surface facing light source 8 that is configured to help direct light emitted from light source 8 through all portions of light shield 3.

Figure 25:
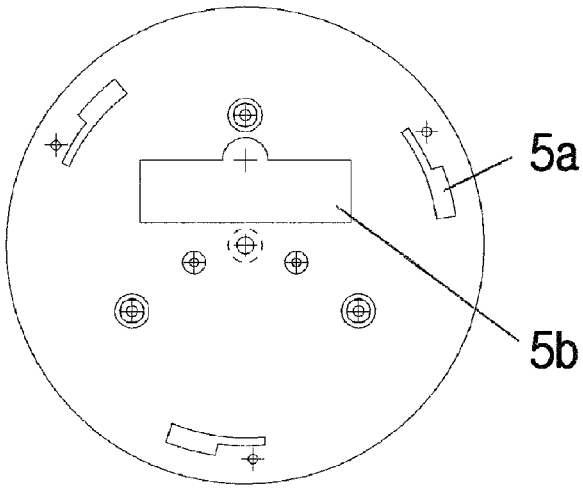
FIG. 25 is a top view of the disk-like light-holding bracket used as a part of the most preferred embodiment of the present invention, showing the surface positioned adjacent to the cap.
Figure 26:
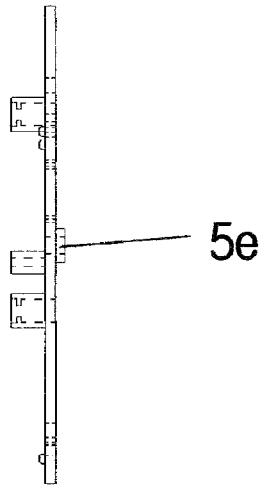
FIG. 26 is a first side view of the light-holding bracket of the invention.
Figure 27:
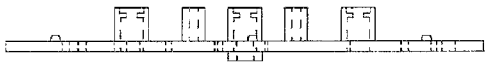
FIG. 27 is a second side view of the light-holding bracket of the invention taken at 90-degrees to that shown in FIG. 27.
Figure 28:
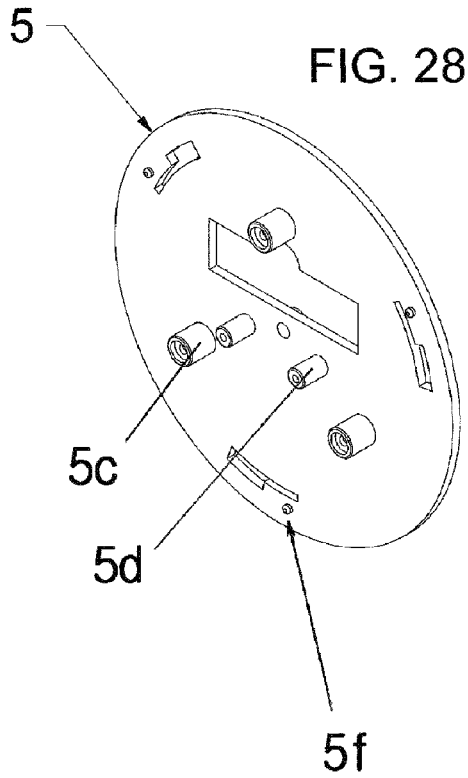
FIG. 28 is a perspective view of the light-holding bracket of the invention showing its upwardly-facing surface adjacent to the cap.

FIGS. 25-28 show enlarged views of the horizontally-extending light-holding bracket 5 used as a part of the most preferred embodiment of the present invention. FIG. 25 is a top view of light holding bracket 5 that shows the surface facing away from base 1, with the mount 5*e* employed to secure light source 8 shown in broken lines (as it faces base 1). FIG. 25 also shows three key-hole shaped slots 5*a* that are used with a bayonet turn (or other twisting action) to secure an L-shaped projection 3*a* depending from one end of light shield 3, three small locking nodes 5*f* that each engage a different notch 3*b* in the distal end of an L-shaped projection 31, two small mounts 5*d* employed for securing circuit board 7 to bracket 5, three large threaded mounts 5*c* that are each employed to secure a mounting projection 14*b* to bracket 5, and one large rectangular opening 5*b* employed to secure battery compartment 6 to bracket 5 which further has a generally D-shaped cut-out (not separated numbered) in one of its longer sides, and into which the tip of a finger can be inserted to easily release battery compartment cover 9 from battery compartment 6 when needed for battery replacement. The positioning of the D-shaped cut-out along the perimeter of large opening 5*b* may be different (i.e. not longitudinally centered) from that shown in FIGS. 25 and 28, and should not be considered as limiting. FIG. 26 is a first side view of bracket 5, and FIG. 27 provides a second side view of bracket 5 taken at 90-degrees to that shown in FIG. 27 (which reveals both small mounts 5*d* and all three large threaded mounts 5*c*). In addition, FIG. 28 is a perspective view of bracket 5 mainly showing its top surface. The number, size, configuration, location, and spaced-apart distances from one another of small mounts 5*c*, large threaded mounts 5*c*, large opening 5*b*, slots 5*a*, and locking nodes 5*f*, can be different from that shown in FIGS. 25-28, as long as they continue to complement the other present invention features with which they are intended to become engaged. Conversely, it is preferred that the centrally-positioned mount 5*e* would remain in the same location shown, to direct emitted light equally to all sides of light shield 3, unless a different combination of light source 8 and reflector 4 was employed.

Figure 29:
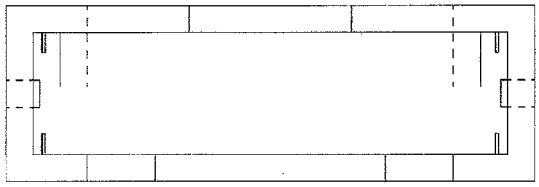
FIG. 29 is a top view of the battery compartment used as a part of the most preferred embodiment of the present invention.
Figure 30:
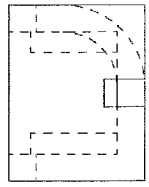
FIG. 30 is a first side view of the battery compartment of the invention.
Figure 31:
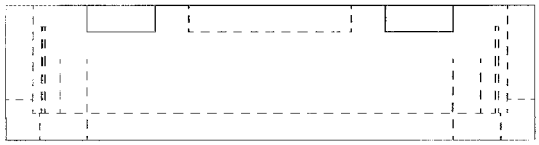
FIG. 31 is a second side view of the battery compartment of the invention taken at 90-degrees to that shown in FIG. 30.
Figure 32:
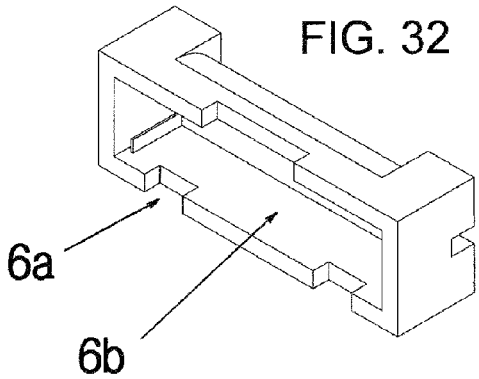
FIG. 32 is a perspective view of the battery compartment of the invention showing its interior battery-holding chamber.
Figure 33:
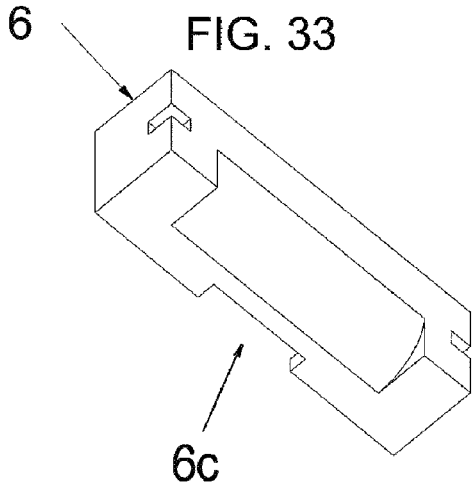
FIG. 33 is a perspective view of the battery compartment of the invention showing its exterior surfaces.

FIGS. 29-33 show enlarged views of the generally rectangular-shaped battery compartment 6 used as a part of the most preferred embodiment of the present invention. FIGS. 29-32 show the interior chamber 6*b* in battery compartment 6 having the elongated shape suitable for use of a standard size of 'AA' or 'AAA' battery (disposable or rechargeable). In addition, FIGS. 31 and 32 show the cut-outs 6*a* employed for engaging the tabs 9*a* shown in FIGS. 42-45 on battery compartment cover 9. A large side cut-out 6*c* is also marked in FIG. 33, which is used with longitudinal slot 9*e* for removing battery compartment cover 9 for battery replacement. One simply slips the tip of a finger through the D-shaped cut-out associated with large rectangular opening 5*b*. Then, via a combination of pushing on slot 9*e* and gaining leverage through cut-out 6*c* to grasp battery compartment cover 9 after it is released, the action of pushing on slot 9*e* releases the two tabs 9*d* on battery compartment cover 9 from their sealing contact with battery compartment 6, and battery compartment cover 9 can then be removed through the large rectangular opening in bracket 5 to reveal the battery in need of replacement. A simple battery exchange can then take place, with reverse steps re-establishing battery compartment cover 9 into its desired position of use. FIG. 29 is a top view of battery compartment 6, while FIG. 30 is a first side view of battery compartment 6, and FIG. 31 provides a second side view of battery compartment 6 taken at 90-degrees to that shown in FIG. 30. In addition, FIG. 32 is a perspective view of battery compartment 6 showing its interior surface, and FIG. 33 is a perspective view of battery compartment 6 showing its exterior surfaces. It should also be noted herein that it is contemplated for the configuration of battery compartment 6 to have non-patentably distinct differences from that shown in FIGS. 29-33, without departing from the scope and intent of the present invention.

Figure 34:
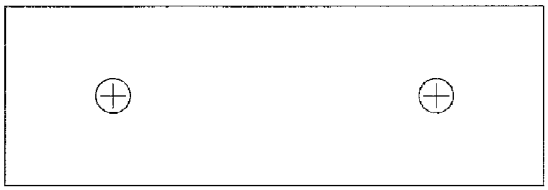
FIG. 34 is a top view of a circuit board contemplated for use as a part of the most preferred embodiment of the present invention, showing its generally rectangular configuration and fastener holes used for circuit board connection to the light-holding bracket.
Figure 35:
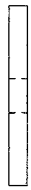
FIG. 35 is a first side view of the circuit board of the invention.
Figure 36:
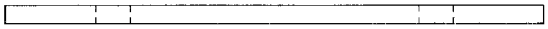
FIG. 36 is a second side view of the circuit board of the invention taken at 90-degrees to that shown in FIG. 35.
Figure 37:
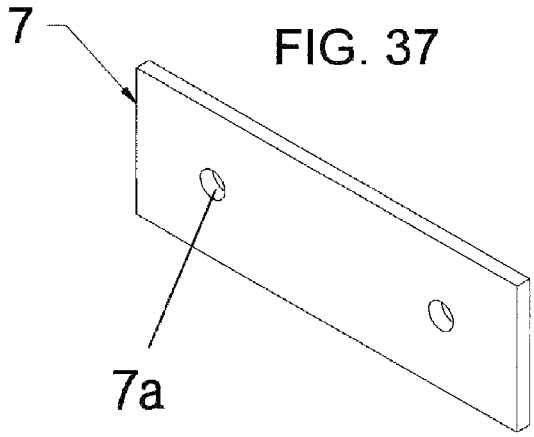
FIG. 37 is a perspective view of the circuit board of the invention without any through-hole paths, mounted electrical components, or surface ornamentation for simplicity of illustration.

FIGS. 34-37 show enlarged views of the circuit board 7 employed as a part of the most preferred embodiment of the present invention, and secured to bracket 5 via small mounts 5*d*. Circuit board 7 is shown without conductive traces, through-hole paths, and mounted electrical components, which would be determined during manufacture and configured according to electrical circuit requirements and cost considerations. Also, the size, number, and spaced-apart positioning of fastener holes 7*a* is not limited to that shown, but should complement the number, size, and positioning of the small mounts 5*d* present on bracket 5. FIG. 34 is a top view of circuit board 7, while FIG. 35 is a first side view of circuit board 7, and FIG. 36 provides a second side view of circuit board 7 taken at 90-degrees to that shown in FIG. 35. In addition, FIG. 37 is a perspective view of the generally rectangular configuration that would be most often expected for circuit board 7.

Figure 38:
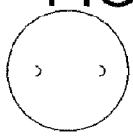
FIG. 38 is a top view of the LED light source contemplated for use as a part of the most preferred embodiment of the present invention.
Figure 39:
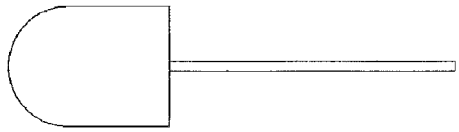
FIG. 39 is a first side view of the LED light source of the invention.
Figure 40:
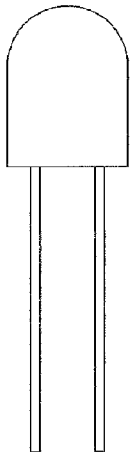
FIG. 40 is a second side view of the LED light source of the invention taken at 90-degrees to that shown in FIG. 39.
Figure 41:
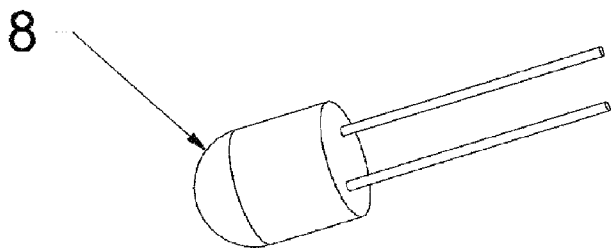
FIG. 41 is a perspective view of the LED light source of the invention.

FIGS. 38-41 show enlarged views of the light emitting diode (LED) light source 8 contemplated for use as a part of the most preferred embodiment of the present invention. FIG. 38 is a top view of light source 8, while FIG. 39 is a first side view of light source 8, and FIG. 40 is a second side view of light source 8 taken at 90-degrees to that shown in FIG. 39 and showing both of its electrical leads. In addition, FIG. 41 is a perspective view of light source 8. Although in the most preferred embodiment of the present invention it is contemplated for light source 8 to be a light emitting diode (LED), the features desired in light source 8 are low power consumption, compact size, enhanced brightness of the emitted light, and a low amount of heat produced during light production, and any technology meeting these requirements could also be used. Light source 8 is secured against mount 5*e* in bracket 5, and soldered to circuit board 7. Thus, when a light emitting diode (LED) is used it would not need to be replaceable, as it would be expected to have an average useful life of approximately 50,000 hours. Also, although the most preferred embodiment of the present invention has only one light source 8, the use of more than one light source 8 as a part of the present invention should also be considered within its scope.

Figure 42:
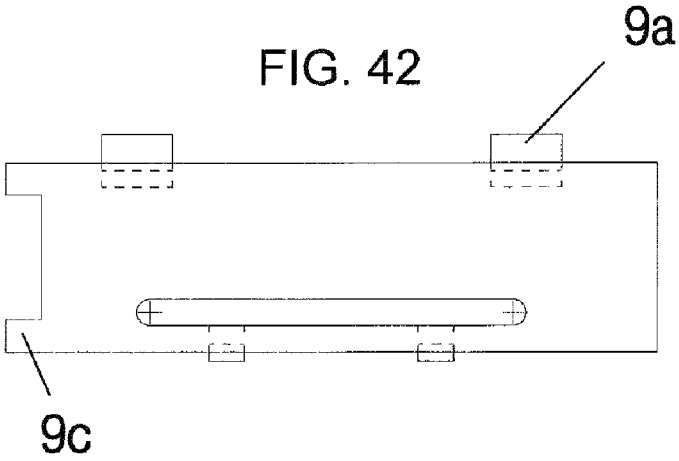
FIG. 42 is a top view of the easily-releasable snap-in battery compartment cover used as a part of the most preferred embodiment of the present invention, showing the surface facing the light shield and a non-centered longitudinally-extending slot, with broken lines showing portions of the projections/tabs that are hidden from view.
Figure 43:
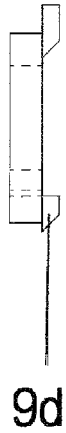
FIG. 43 is a first side view of the battery compartment cover of the invention.
Figure 44:
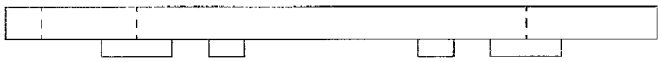
FIG. 44 is a second side view of the battery compartment cover of the invention taken at 90-degrees to that shown in FIG. 43.
Figure 45:
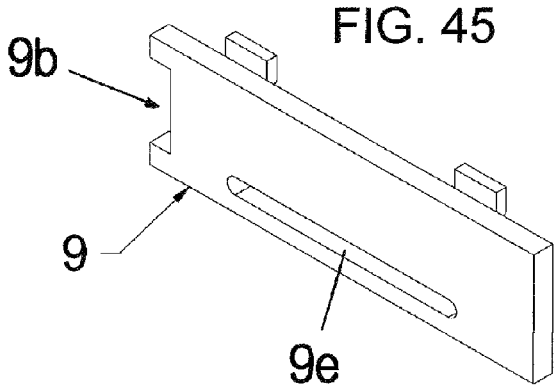
FIG. 45 is a perspective view battery compartment cover of the invention showing the same surface shown in FIG. 42.

FIGS. 42-45 show enlarged views of the snap-in battery compartment cover 9 used as a part of the most preferred embodiment of the present invention. FIG. 42 is a top view of battery compartment cover 9, while FIG. 43 is a first side view of battery compartment cover 9, and FIG. 44 is a second side view of battery compartment cover 9 taken at 90-degrees to that shown in FIG. 43. Additionally, FIG. 45 is a perspective view battery compartment cover 9 showing cover 9 having a generally rectangular configuration, with two spaced-apart tabs 9*a* positioned along one of its longer sides and a cut-out

9*b* on one of its ends used to create two tabs 9*c* that assist in securing battery compartment cover 9 between battery compartment 6 and bracket 5. FIGS. 42 and 43 also show the two locking snap-in tabs 2*d* employed to seal battery compartment cover 9 over the interior chamber 6*b* of battery compartment 6. It is preferred for battery compartment cover 9 to be made from plastic and have a snap-in connection to battery compartment 6. To replace a battery in the most preferred embodiment of the present invention, one would first lift the removable, assembled multi-part top unit comprising main body 2, light shield 3, and cap 13 from base 1. Then, holding main body 2 and light shield 3 in separate hands, light shield 3 would be twisted counterclockwise to separate it from main body 2. Subsequently, the tip of a finger could be inserted through the D-shaped cut-out (not separately numbered) in bracket 5, and through the large side cut-out 6*c*, and then used to push on slot 9*e* to disengage locking snap-in tabs 9*d*. Battery compartment cover 9 can then be grasped and lifted from its position of use. Once battery exchange takes place, reverse steps will reassemble battery compartment 6 and its cover 9, and then can be used to reattach light shield 3 to main body 2. Battery replacement is easy and fast, typically taking a maximum of three minutes (or less).

Figure 46:
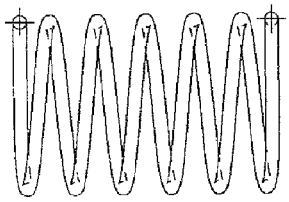
FIG. 46 is a first side view of a battery spring contemplated for use as a part of the most preferred embodiment of the present invention.
Figure 47:
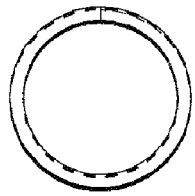
FIG. 47 is a top view of the battery spring of the invention.
Figure 48:
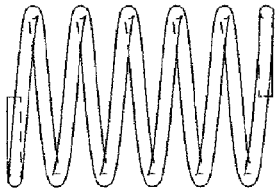
FIG. 48 is a second side view of the battery spring of the invention taken at 90-degrees to that shown in FIG. 53.
Figure 49:
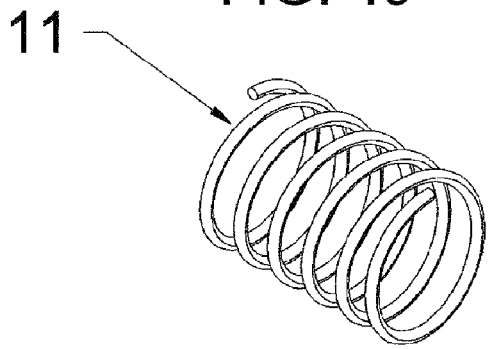
FIG. 49 is a perspective view of the battery spring of the invention.

FIGS. 46-49 show enlarged views of the electrically-conductive battery spring 11 used as a part of the most preferred embodiment of the present invention. FIG. 46 is a first side view of battery spring 11, while FIGS. 47 and 48 respectively provide a top view of battery spring 11 and a second side view of battery spring 11 taken at 90-degrees to that shown in FIG. 46. In addition, FIG. 49 is a perspective view of battery spring 11. Although the configuration of the battery spring 11 shown in FIGS. 46-49 is preferred, its shape and the materials used may vary, as long as it fulfills its intended function of securing a the ends of a rechargeable or disposable battery against battery contact 12.

Figure 50:
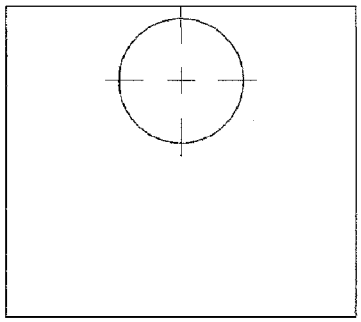
FIG. 50 is a top view of the battery contact used as a part of the most preferred embodiment of the present invention, with the horizontally-extending and vertically-extending 'site' lines indicating a raised configuration.
Figure 51:
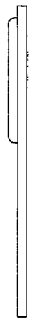
FIG. 51 is a first side view of the battery contact of the invention.
Figure 52:
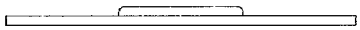
FIG. 52 is a second side view of the battery contact of the invention taken at 90-degrees to that shown in FIG. 51.
Figure 53:
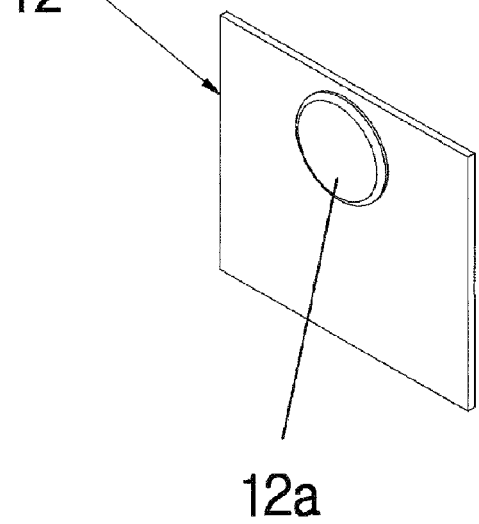
FIG. 53 is a perspective view of the battery contact of the invention showing its top surface.

FIGS. 50-54 show enlarged views of the electrically-conductive battery contact 12 used as a part of the most preferred embodiment of the present invention. FIG. 50 is a top view of battery contact 12, while FIG. 51 is a first side view of battery contact 12, and FIG. 52 provides a second side view of battery contact 12 taken at 90-degrees to that shown in FIG. 51. In addition, FIG. 53 is a perspective view of battery contact 12 showing its top surface, and the raised contact button 12 a placed in direct contact with one end of a battery housed within battery compartment 6 or battery spring 11. An independent battery contact 13 is used in connection with each end of a battery housed within battery compartment 6. While the configuration shown in FIGS. 50-54 for battery contact 12, such as its perimeter configuration or surface appearance, is not critical, it may differ from that shown only if it is still able to successfully fulfill its intended function as part of the electrical connection required for light source 8 operation.

Figure 54:
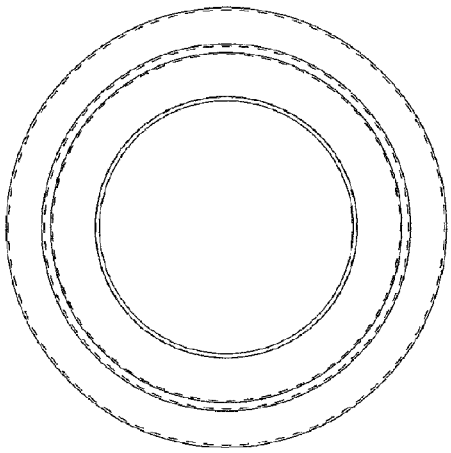
FIG. 54 is a top view of the cap used as a part of the most preferred embodiment of the present invention.
Figure 55:
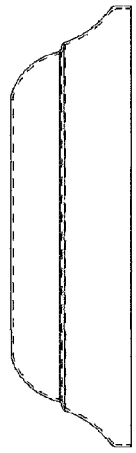
FIG. 55 is a first side view of the cap of the invention.
Figure 56:
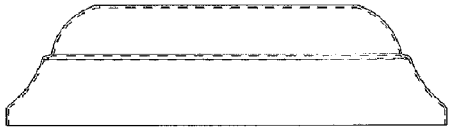
FIG. 56 is a second side view of the cap of the invention taken at 90-degrees to that shown in FIG. 55.
Figure 57:
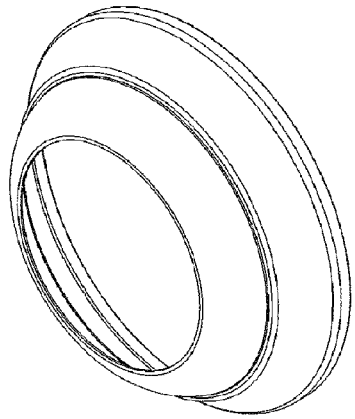
FIG. 57 is a perspective view of the cap of the invention showing its top opening and exterior surface.
Figure 58:
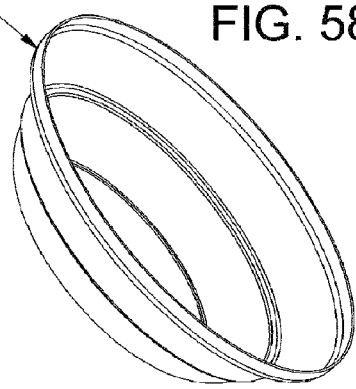
FIG. 58 is a perspective view of the cap of the invention showing its interior surface.

FIGS. 54-58 show enlarged views of the upwardly and inwardly tapering configuration of the cap 13 used as a part of the most preferred embodiment of the present invention. FIGS. 54 and 57-58 collectively also show cap 13 having an open-ended configuration on both of its ends. FIG. 54 is a top view of cap 13, while FIG. 55 is a first side view of cap 13 and FIG. 56 provides a second side view of cap 13 taken at 90-degrees to that shown in FIG. 55. Additionally, FIG. 57 is a perspective view of cap 13 showing its top and side surfaces and FIG. 58 is a perspective view of cap 13 showing its side surface and a portion of its interior surface. In the most preferred embodiment of the present invention cap 13 is supported by top photo-sensor/switch plate 14 and bracket 5, with photo-sensor/switch 14*a* exposed for light (or reduced light) activation through the smaller end of cap 13. Plate 14 and cap 13 have a secure connection to one another, which can be achieved via bonding, welding, or glue, or in the alternative formed as a one-piece unit via molded construction. The same or different materials used for manufacture of base 1 and main body 2 can be used for manufacture of cap 13, or different materials may be employed.

Figure 59:
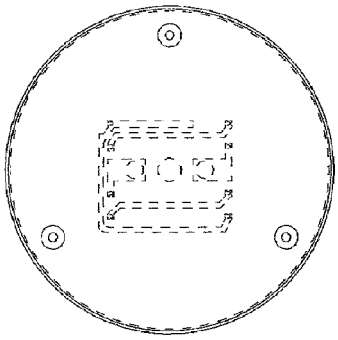
FIG. 59 is a bottom view of the top plate with photovoltaic cell that is used with the cap as a part of the most preferred embodiment of the present invention, showing the three spaced-apart mounting projections near its perimeter that are used for top plate connection to the light-holding bracket, and broken lines identifying the location of the photo-sensor/switch secured to its reverse surface.
Figure 60:
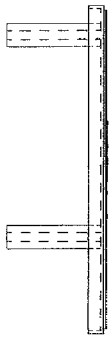
FIG. 60 is a first side view of the top plate of the invention.
Figure 61:
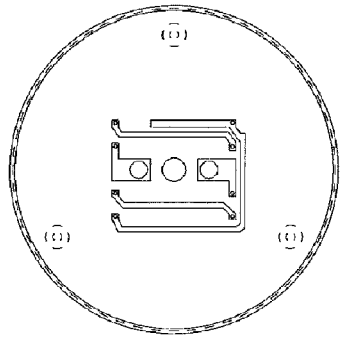
FIG. 61 is a top view of the top plate of the invention, showing the central exterior position preferred for the photo-sensor/switch after top plate and cap assembly, with broken lines indicating preferred positioning for the three mounting projections connecting the top plate to the light-holding bracket.
Figure 62:
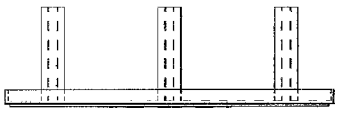
FIG. 62 is a second side view of the top plate of the invention taken at 90-degrees to that shown in FIG. 60.

FIGS. 59-63 show enlarged views of the top photo-sensor/switch plate 14 used as a part of the most preferred embodiment of the present invention. Photo-sensor/switch plate 14 can be manufactured as an independent component, or formed as a part of cap 13 via molded construction. FIG. 59 is a bottom view of top photo-sensor/switch plate 14 showing its three spaced-apart mounting projections (marked with the numeral 14*b* in FIG. 63) as mere circles, since they are extending toward a viewer. FIG. 59 also shows a photo-sensor/switch (marked with the numeral 14*a* in FIG. 63) in broken lines, since it is attached to the reverse (top) side of photo-sensor/switch plate 14 and is hidden from view. In contrast, FIG. 60 is a first side view of top photo-sensor/switch plate 14 showing two of the three mounting projections 14*b*, while FIG. 62 provides a second side view of top photo-sensor/switch plate 14 taken at 90-degrees to that shown in FIG. 60, and showing all three mounting projections 14*b*. Although three mounting projections 14*b* are employed in the most preferred embodiment of the present invention, the number and positioning used for mounting projections 14*b* are not critical as long as cap 13 is stably secured in its position of use above light shield 3. FIG. 61 is a top view of top photo-sensor/switch plate 14 that shows photo-sensor/switch 14*a* secured thereto, and further shows the three mounting projections 14*b* extending rearward away from a viewer and marked in broken lines since they are connected to the reverse side of mounting projections 14*b*. After cap 13 is supported upon top photo-sensor/switch plate 14, the central portion of top photo-sensor/switch plate 14, with the attached photo-sensor/switch 14*a*, remains visible to a viewer (as shown in the assembled view of the present invention illustrated in FIG. 4). FIG. 63 provides a perspective view of photo-sensor/switch plate 14 that shows its top and side surfaces, photo-sensor/switch 14*a*, and two of its three mounting projections 14*b* extending from the opposing (bottom/interior) surface of photo-sensor/switch plate 14. The thickness of photo-sensor/switch plate 14 is not critical, but should not add surplus weight to the present invention without corresponding benefit. The fasteners 10 shown in FIG. 5 would be used to assemble bracket 5 to the distal ends of the mounting projections 14*b* depending from photo-sensor/switch plate 14 at the time of manufacture, as well as a circuit board 7 to bracket 5. Furthermore, although photo-sensor/switch 14*a* in the most preferred embodiment of the present invention comprises photovoltaic cell, any other photo-sensor/switch arrangement fulfilling the same function and design requirements can be used.

What is claimed is:

1. A holder for a single roll of toilet paper that is compact in construction and used atop a toilet tank cover, said holder comprising:

a cylindrical main body having minimum diameter and height dimensions configured to hold one roll of toilet paper, a closed upper end with a perimeter recess, and an open lower end with a bottom edge;

a base having a minimum diameter dimension greater than that of said main body, said base also having a perimeter groove configured to removably receive said bottom edge of said main body and restrict lateral movement of said bottom edge relative to said base;

a translucent light shield supported by said main body, said light shield configured for a removable twisting connection to said closed upper end of said main body, with said light shield and said main body each also configured for locking connection therebetween that resists release by casual contact, said light shield also having a diameter dimension less than that of said main body;

a horizontally-extending light-holding bracket supported by said light shield, said bracket and said light shield configured for a removable twisting connection of one to the other, with said light shield and said bracket each also configured for locking connection therebetween that resists release by casual contact;

a circuit board secured to said bracket;

a low-power-consumption and low-heat-producing light source supported by said bracket, said light source electrically connected to said circuit board;

a power supply compartment supported by said bracket and electrically connected to said circuit board, said power supply compartment configured for receipt of at least one battery;

a combined cap and plate supported by at least one mounting projection secured to said bracket, said cap having its greatest diameter dimension larger than that of said light shield, with said cap also configured with sufficient height dimension to cover and protect said circuit board, said power supply compartment, and said bracket; and photo-sensor and switch means adapted for automated activation of said light source in low-light ambient conditions and deactivation when ambient light exceeds a pre-established threshold level, said photo-sensor and switch means further adapted for automatic recharging during daylight conditions of a battery positioned within said power supply compartment, said photo-sensor and switch means electrically connected to said circuit board and supported by said plate in a position available for receipt of ambient light, wherein when said holder is positioned atop a toilet tank cover, a roll of toilet paper is positioned within said main body and supported by said base, and at least one battery is placed into said power supply compartment, the roll of toilet paper covered by said main body remains close to its intended location of use and in a protected and sanitary condition, said light source automatically becomes activated in low-light ambient conditions and emitted light emitted from said light source passes through said translucent light shield to provide a night light function, and when the battery positioned within said power supply compartment is rechargeable, and further when ambient light exceeds a pre-established threshold level, said light source is deactivated and charging of said rechargeable battery occurs instead until the next time that low-light ambient conditions again cause said light source to become activated.

2. The holder of claim 1 further comprising a reflector positioned within said light shield and configured to cause deflection of light emitted by said light source in a downwardly direction toward said main body, and redirection of such deflected light toward said light shield.

3. The holder of claim 2 wherein said reflector is supported by said closed upper end of said main body.

4. The holder of claim 3 wherein said reflector is generally mushroom-shaped with a rounded top and a stem, said closed upper end of said main body has a central bore, and said stem engages said central bore for support.

5. The holder of claim 1 wherein said bracket comprises a large opening and said power supply compartment further comprises a snap-in battery compartment cover, said battery compartment cover is partially visible through said large opening.

6. The holder of claim 5 wherein said large opening in said bracket further comprises a D-shaped cut-out configured to assist removal of said battery compartment cover through said large opening for battery replacement.

7. The holder of claim 1 wherein said main body, said cap, and said base are made from materials selected from a group consisting of corrosion-resistant materials, durable materials, impact-resistant materials, and water-resistant materials.

8. The holder of claim 1 further comprising said cap having a diameter dimension larger than that of said light shield.

9. The holder of claim 1 further comprising said cap having a diameter dimension larger than that of said light shield and said main body.

10. The holder of claim 1 further comprising said cap having a diameter dimension similar to that of said main body.

11. The holder of claim 1 further comprising said cap and said main body each having a diameter dimension larger than that of said light shield.

12. The holder of claim 1 further comprising said cap and said main body each having a diameter dimension larger than that of said light shield, and said cap has a diameter dimension similar to that of said main body.

13. The holder claim 1 further comprising connection of said main body to said light shield via L-shaped projections depending from said light shield and key-shaped slots through said perimeter recess in said closed upper end of said main body.

14. The holder claim 1 further comprising connection of said bracket to said light shield via L-shaped projections depending from said light shield and key-shaped slots through said bracket.

15. The holder claim 1 further comprising connection of said main body to said light shield via L-shaped projections depending from said light shield and key-shaped slots through said closed upper end of said main body, and also further comprising connection of said bracket to said light shield via L-shaped projections depending from said light shield and key-shaped slots through said bracket.

16. The holder of claim 1 wherein said base further comprises a plurality of feet.

17. A method for providing protected storage of a single roll of toilet paper atop a toilet tank cover while also providing a nightlight function during low-light ambient conditions to facilitate access to said roll of toilet paper, said method comprising the steps of:

providing the holder of claim 1 and a single roll of toilet paper;

separating said cylindrical housing from said base;

placing said roll of toilet paper upon said base;

replacing said cylindrical housing upon said base, over said roll of toilet paper; and using illumination from said light source to locate said holder, separate said cylindrical housing from said base, remove said roll of toilet paper from said cylindrical housing, and replace said roll of toilet paper upon said base.

18. The method of claim 17 further comprising a reflector supported by said closed upper end of said main body and positioned within said light shield, said reflector also configured to deflect light emitted by said light source in a downwardly direction toward said main body, and redirect it toward said light shield, and further wherein said base has a plurality of feet.

19. The method of claim 17 wherein connection of said main body to said light shield uses L-shaped projections depending from said light shield and key-shaped slots through said closed upper end of said main body, and also wherein connection of said bracket to said light shield uses L-shaped projections depending from said light shield and key-shaped slots through said bracket.

20. A holder for a single roll of toilet paper that is sufficiently compact in construction for placement atop a toilet tank cover, said holder comprising:

a cylindrical main body having diameter and height dimensions sufficiently large to hold one roll of toilet paper, a closed upper end, and an open-ended lower end;

a base having a plurality of feet and a diameter dimension sufficiently large to support a roll of toilet paper, said base also having a perimeter groove configured to removably receive said lower end of said main body and non-sliding engagement thereof;

a translucent light shield supported by said main body and connected there to via twisting engagement of a plurality of L-shaped projections depending from said light shield each with a key-shaped slots through said closed upper end of said main body;

a substantially horizontally-extending light-holding bracket supported by said light shield;

a circuit board secured to said bracket;

a light emitting diode supported by said bracket and electrically connected to said circuit board;

a reflector positioned within said light shield and configured to deflect light emitted by said light emitting diode in a downwardly direction toward said main body, and redirect it toward said light shield, said reflector supported by said closed upper end of said main body;

a rechargeable battery in a battery compartment supported by said bracket and electrically connected to said circuit board;

a snap-in battery compartment cover associated with said battery compartment to seal it;

a plate with at least one mounting projection secured to said bracket;

photo-sensor and switch means adapted for automated activation of said light source in low-light ambient conditions and automatic recharging of said power source in daylight conditions, said photo-sensor and switch means supported by said plate and electrically connected to said circuit board; and a cap supported by said plate so that said cap does not cover said photo-sensor and switch means on said plate, wherein when said holder positioned atop a toilet tank cover, it can provide a spare roll of toilet paper and also automatically function as a night light in low-light ambient conditions via transmission of light emitted by said light emitting diode through said translucent light shield.

* * * * *